US009631573B2

(12) United States Patent
Surnilla et al.

(10) Patent No.: US 9,631,573 B2
(45) Date of Patent: Apr. 25, 2017

(54) METHODS AND SYSTEMS FOR ADJUSTING FUELING OF ENGINE CYLINDERS

(71) Applicant: Ford Global Technologies, LLC, Dearborn, MI (US)

(72) Inventors: Gopichandra Surnilla, West Bloomfield, MI (US); Adithya Pravarun Re Ranga, Canton, MI (US); Joseph Lyle Thomas, Kimball, MI (US); Ethan D. Sanborn, Saline, MI (US); Xiaoying Zhang, Dearborn Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 189 days.

(21) Appl. No.: 14/535,981

(22) Filed: Nov. 7, 2014

(65) Prior Publication Data

US 2016/0131072 A1 May 12, 2016

(51) Int. Cl.

| | |
|---|---|
| ***F02D 41/30*** | (2006.01) |
| ***F02D 41/04*** | (2006.01) |
| ***F02D 41/26*** | (2006.01) |
| ***F02D 41/14*** | (2006.01) |
| ***F02D 41/22*** | (2006.01) |
| *F02D 41/24* | (2006.01) |

(52) U.S. Cl.

CPC ..... *F02D 41/3094* (2013.01); *F02D 41/1454* (2013.01); *F02D 41/222* (2013.01); *F02D 41/1456* (2013.01); *F02D 41/2406* (2013.01)

(58) Field of Classification Search

CPC ..... F02D 41/04; F02D 41/26; F02D 41/3005; F02D 41/3094; F02D 41/222; F02D 41/1454; F02D 41/2406; F02D 41/1456

USPC ..... 73/114.38, 114.45, 114.48, 114.49, 73/114.51, 114.77; 701/103, 107

See application file for complete search history.

(56) References Cited

U.S. PATENT DOCUMENTS

| | | | | |
|---|---|---|---|---|
| 7,730,872 | B2 | 6/2010 | Leone et al. | |
| 2009/0216429 | A1* | 8/2009 | Yamashita | F02D 41/0002 701/107 |
| 2012/0277979 | A1* | 11/2012 | Kato | F02D 41/0085 701/104 |
| 2012/0297866 | A1* | 11/2012 | Tanaka | G01M 15/104 73/114.31 |
| 2014/0290219 | A1* | 10/2014 | Kato | F02D 41/1441 60/276 |

* cited by examiner

*Primary Examiner* — Hieu T Vo
*Assistant Examiner* — Arnold Castro
(74) *Attorney, Agent, or Firm* — Julia Voutyras; McCoy Russell LLP

(57) ABSTRACT

Systems and methods for improving fuel injection of an engine that includes a cylinder receiving fuel from two different fuel injectors is disclosed. In one example, fueling errors for each of the two fuel injectors are determined based on fractions of fuel supplied by the two fuel injectors during different engine operating conditions.

18 Claims, 4 Drawing Sheets

200

| ENGINE LOAD | 500 | 1000 | 2000 | 3000 | 4000 | 5000 |
|---|---|---|---|---|---|---|
| 0.9 | 1 | 0.98 | 1 | 1.01 | 1.02 | 1 |
| 0.8 | 1 | 1 | 0.98 | 0.99 | 1 | 1 |
| 0.7 | 1.01 | 1 | 0.96 | 1.03 | 1.03 | 1 |
| 0.6 | .99 | .99 | 0.97 | .99 | 0.98 | 0.99 |
| 0.5 | 0.99 | 0.97 | 0.96 | 1.01 | 1.02 | 0.98 |
| 0.4 | 1.01 | 1 | 0.98 | 1.02 | 1 | 0.97 |
| 0.3 | 0.98 | 1 | 0.99 | 1 | 1.01 | 0.98 |
| 0.2 | 0.96 | 0.99 | 1.01 | 1 | 1.02 | 0.99 |
| 0.1 | 0.97 | 0.96 | 1 | 1.02 | 1.02 | 1 |
| 0 | 0.98 | 0.99 | 1 | 1.02 | 1.02 | 1 |

ENGINE SPEED

METHODS AND SYSTEMS FOR ADJUSTING FUELING OF ENGINE CYLINDERS

FIELD

The present description relates to a system and methods for supplying fuel to cylinders of an internal combustion engine. The methods may be particularly useful for an engine that includes both port and direct fuel injectors.

BACKGROUND AND SUMMARY

An engine may be supplied fuel by both port and direct fuel injectors. The port fuel injectors may provide advantages during cold engine starting, and the direct fuel injectors may provide advantages when the engine is operated at higher speeds and loads. For example, during cold engine starts, directly injected fuel may impinge on engine pistons where soot may form, thereby increasing engine particulate matter output. However, if fuel is port injected, the injected fuel may evaporate as it is being drawn into engine cylinders so that less particulate matter is formed. At warmer temperatures, directly injected fuel may cool cylinder charge mixtures so that an engine may be less prone to knock at higher engine speeds and loads during warm engine operating conditions. Consequently, directly injected engines may exhibit improved fuel economy and improved performance. Additionally, it may be desirable to operate both direct injectors and port injectors during some operating conditions to improve combustion stability and engine emissions.

Thus, it may be beneficial to incorporate port and direct fuel injectors into an engine. However, supplying fuel via two different injection systems may make it difficult to ascertain which fuel injection system is providing more or less fuel than is desired during some operating conditions. Determining which injection system is providing more or less fuel than is desired may be particularly difficult when both injection systems are providing fuel to the engine. Therefore, it may be desirable to be able to determine which fuel injection source may be introducing fueling errors to the engine.

The inventors herein have recognized the above-mentioned disadvantages and have developed a method for fueling a cylinder, comprising: injecting fuel to the cylinder via a first fuel injector and a second fuel injector; and indicating degradation of the first fuel injector or the second fuel injector in response to a rate of change of air-fuel ratio error and a fraction of fuel injected via the first fuel injector or the second fuel injector.

By allocating portions of an air-fuel error based on fractions of fuel injected to a cylinder, it may be possible to provide the technical result of differentiating fueling errors from one fueling system in a system where two fueling systems provide fuel to engine cylinders. For example, engine air-fuel ratio errors may be determined via a difference in a commanded air-fuel ratio and air-fuel ratio as determined from an oxygen sensor. And, a portion of the air-fuel ratio error may be allocated to a direct fuel injection system by dividing a change in air-fuel ratio error by a change in a fuel fraction provided by a direct injection fuel system. Likewise, a portion of the air-fuel ratio error may be allocated to a port fuel injection system by dividing the change in air-fuel ratio error by a change in a fuel fraction provided by a port fuel injection system. In this way, it may be possible to determine which of two fueling systems may be contributing greater fueling errors to engine air-fuel ratio control.

The present description may provide several advantages. In particular, the approach may reduce engine air-fuel error. Further, the approach may make it possible to direct service personnel to one of two separate fuel systems during conditions of fuel system degradation. Further still, the approach may provide for increased operation of a first non-degraded fuel system in the presence of a second degraded fuel system.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
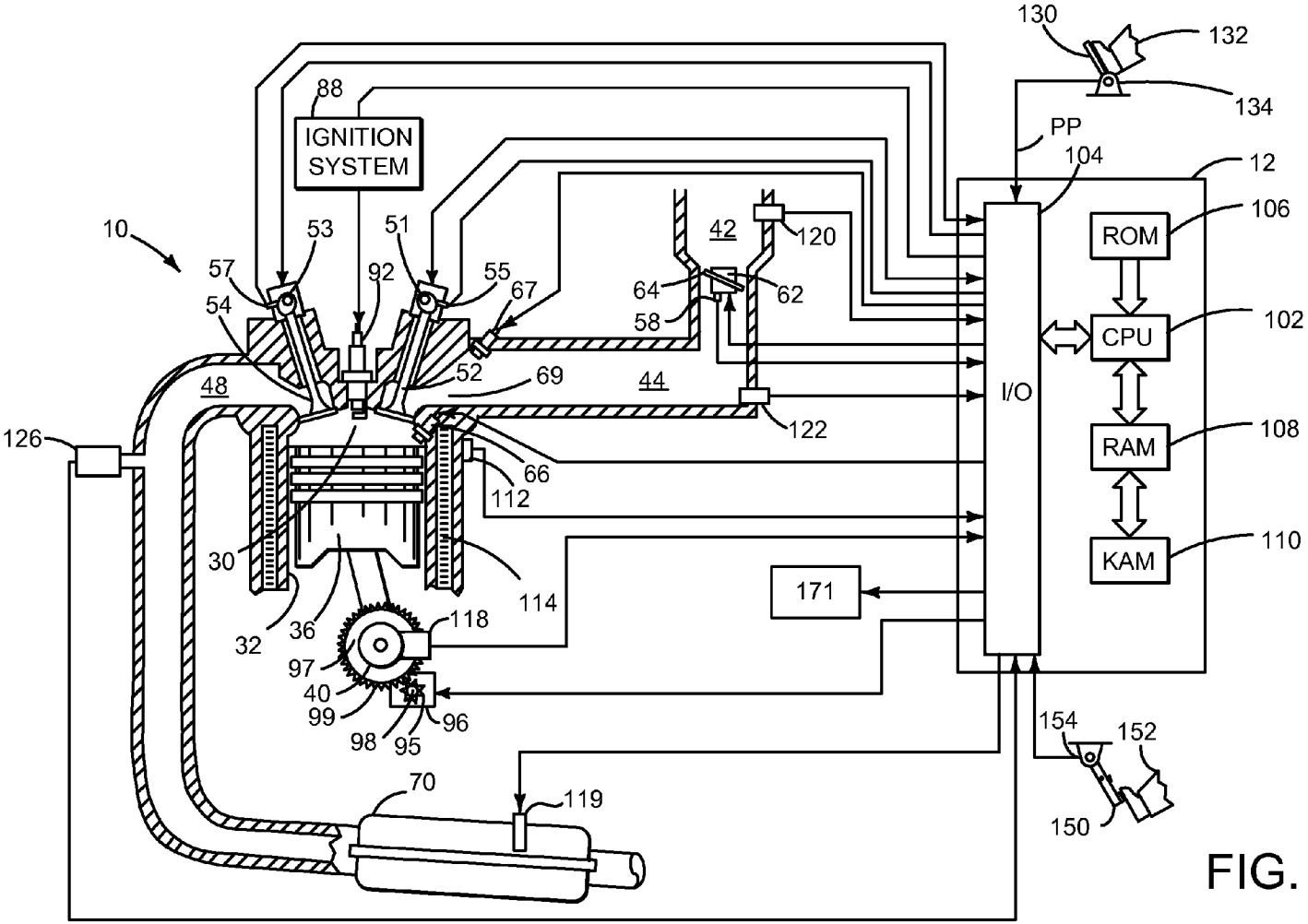
FIG. 1 is a schematic diagram of an engine.
Figures 2A, 2B:
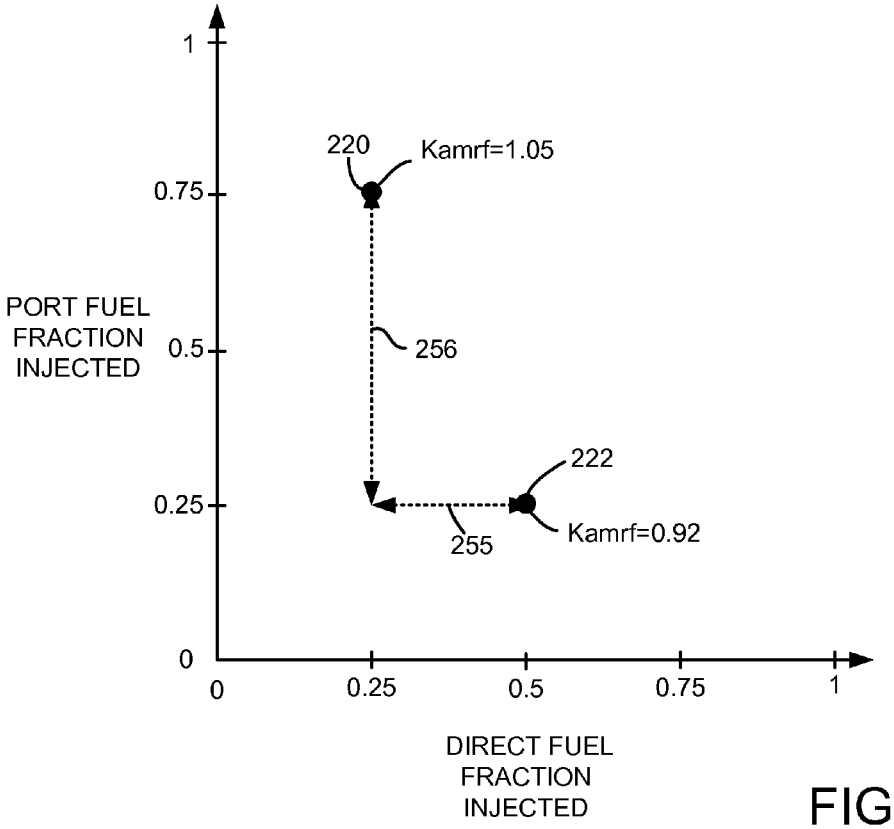
FIG. 2A shows an example table of adapted fuel multipliers.
FIG. 2B shows graphical representation of port injected fuel and direct injected fuel error contributions.

The present description is related to determining sources of fueling errors for an internal combustion engine having cylinders that are supplied fuel by more than one fuel injector. The engine may be configured as is shown in FIG. 1. The engine controller may include a table of adapted fuel parameters as is shown in FIG. 2A. The engine controller may determine which if any fuel systems are providing more or less fuel than is desired to an engine cylinder based on relationships between engine control parameters as shown in FIG. 2B. Determination and mitigation of engine fueling errors may be conducted as is shown in the operating sequence of FIG. 3. Sources of engine fueling errors may be determined by the method of FIG. 4.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 30, which is known to those skilled in the art as direct injection. Port fuel injector 67, injects fuel to intake port 69, which is known to those skilled in the art as port injection. Fuel injector 66 delivers liquid fuel in proportion to a pulse width of a signal from controller 12. Likewise, fuel injector 67 delivers liquid fuel in proportion to a pulse width from controller 12. Fuel is delivered to fuel injectors 66 and 67 by a fuel system (not shown) including a fuel tank, fuel pump, and fuel rail (not shown). Fuel is supplied to direct fuel injector 66 at a higher pressure than fuel is supplied to port fuel injector 67. In addition, intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine with multiple fuel injectors. Further, controller 12 may communicate conditions such as degradation of components to light, or alternatively, display panel 171.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

In this way, the system of FIG. 1 provides for a system, comprising: an engine including a cylinder; a port fuel injector in fluidic communication with the cylinder; a direct fuel injector in fluidic communication with the cylinder; and a controller including executable instructions stored in non-transitory memory for indicating degradation of the port fuel injector or the direct fuel injector and adjusting an actuator in response to a ratio of a change in air-fuel error to a change in fuel fraction. The system includes where the actuator is a fuel injector. The system includes where the change in air-fuel error is based on a change in an adapted fuel multiplier. The system further comprises adapting operation of a fuel injector in response to the ratio. The system includes where the indication of degradation is via a display panel. The system further comprises operating the engine in closed loop air-fuel control to determine air-fuel ratio errors.

Referring now to FIG. 2A, an example table storing adapted fuel multipliers is shown. The values stored in table 200 may be used in following equation to adjust fuel supplied to the engine:

$$\text{Fuel_mass} = \text{air_mass} \cdot \frac{Kamrf}{\text{stoich_afr}} \cdot Lambse$$

where Fuel_mass is the fuel mass delivered to the engine, air_mass is the mass of air inducted to engine cylinders, Kamrf is the adapted fuel multiplier from table 200 of FIG. 2A, stoich_afr is the stoichiometric air-fuel ratio for the fuel supplied to the engine, and Lambse is a fuel correction multiplier formed by a proportional/integral controller that uses air-fueling errors as a basis for controlling engine air-fuel ratio.

Returning back to FIG. 2A, table 200 includes an X axis that partitions the table vertically into a plurality of cells that may be indexed via engine speed. Table 200 also includes a Y axis that partitions the table horizontally into the plurality of cells that may be indexed base on engine load. Thus, the X axis is identified as engine speed and the Y axis is identified as engine load. The table is initially populated with 1's and the 1's are incremented or decremented based on exhaust gas sensor feedback. The table values may be limited or clipped to predetermined values such at between 0.75 and 1.25. Thus, for a plurality of engine speed and load combinations, the amount of fuel delivered to engine cylinders may be adjusted based on values in the table. The table output values are the variable Kamrf. If the engine has multiple cylinder banks, a plurality of Kamrf values may be provided. Kamrf may be an indication of engine air-fuel ratio error. The values in table 200 are based on an error between a desired engine air-fuel ratio and engine air-fuel ratio as determined via an oxygen sensor. Values in table 200 may be incremented or decremented based on lambse values or air-fuel ratio errors between the desired air-fuel ratio and engine air-fuel ratio as determined via an oxygen sensor.

Referring now to FIG. 2B, a graphical representation of port injected fuel error contributions and direct injected fuel error contributions is shown. In particular, values of an adapted fuel error multiplier (Kamrf) are plotted versus fraction of directly injected fuel and fraction of port injected fuel.

The X axis represents fraction of direct fuel injected to engine cylinders. The fraction of direct fuel injected ranges from 0 (e.g., no fuel directly injected) to 1 (e.g., all fuel direct injected during a cylinder cycle being directly injected). The Y axis represents fraction of port fuel injected to engine cylinders. The fraction of port fuel injected ranges from 0 (e.g., no fuel port injected) to 1 (e.g., all fuel port injected during a cylinder cycle being directly injected).

A first Kamrf value of 1.05 is shown at location 220. The portion of directly injected fuel for location 220 is 0.25 as indicated by dotted line 255, and the portion of port injected fuel is 0.75 as indicated by dotted line 256. The fuel fraction values of 0.25 and 0.75 add to a total of 1. Thus, the total amount or mass of fuel injected to the cylinder during a cylinder cycle multiplied by the direct fuel fraction equals the mass of directly injected fuel during the cylinder cycle. Similarly, the total mass of fuel injected to the cylinder during the cylinder cycle multiplied by the port fuel fraction equals the mass of port injected fuel during a cylinder cycle. A second Kamrf value of 0.92 is shown at location 222. The portion of directly injected fuel for location 222 is 0.5 and the portion of port injected fuel is 0.25 of the total amount of fuel injected during a cycle of the cylinder receiving the fuel.

The change in Kamrf from 220 to 222 is 1.05−0.92=0.13. The slope of the change in Kamrf with respect to the change in direct injection fraction is 0.13/(0.25−0.5)=−0.52. The slope of the change in Kamrf with respect to the change in port injection fraction is 0.13/(0.75−0.25)=0.26. Thus, the magnitude of change in Kamrf is greater with respect to the fraction of directly injected fuel that for the port injected fuel. Consequently, the direct fuel injector transfer function may be adjusted and/or the direct fuel injection system may be indicated to be in a degraded condition if the change in Kamrf with respect to the directly injected fuel fraction exceeds a threshold value.

In this way, the adapted fuel error multiplier Kamrf may be a basis for determining port fuel injection system degradation or errors. Further, the same adapted fuel error multiplier may be a basis for determining direct fuel injection system degradation errors.

Figure 3:
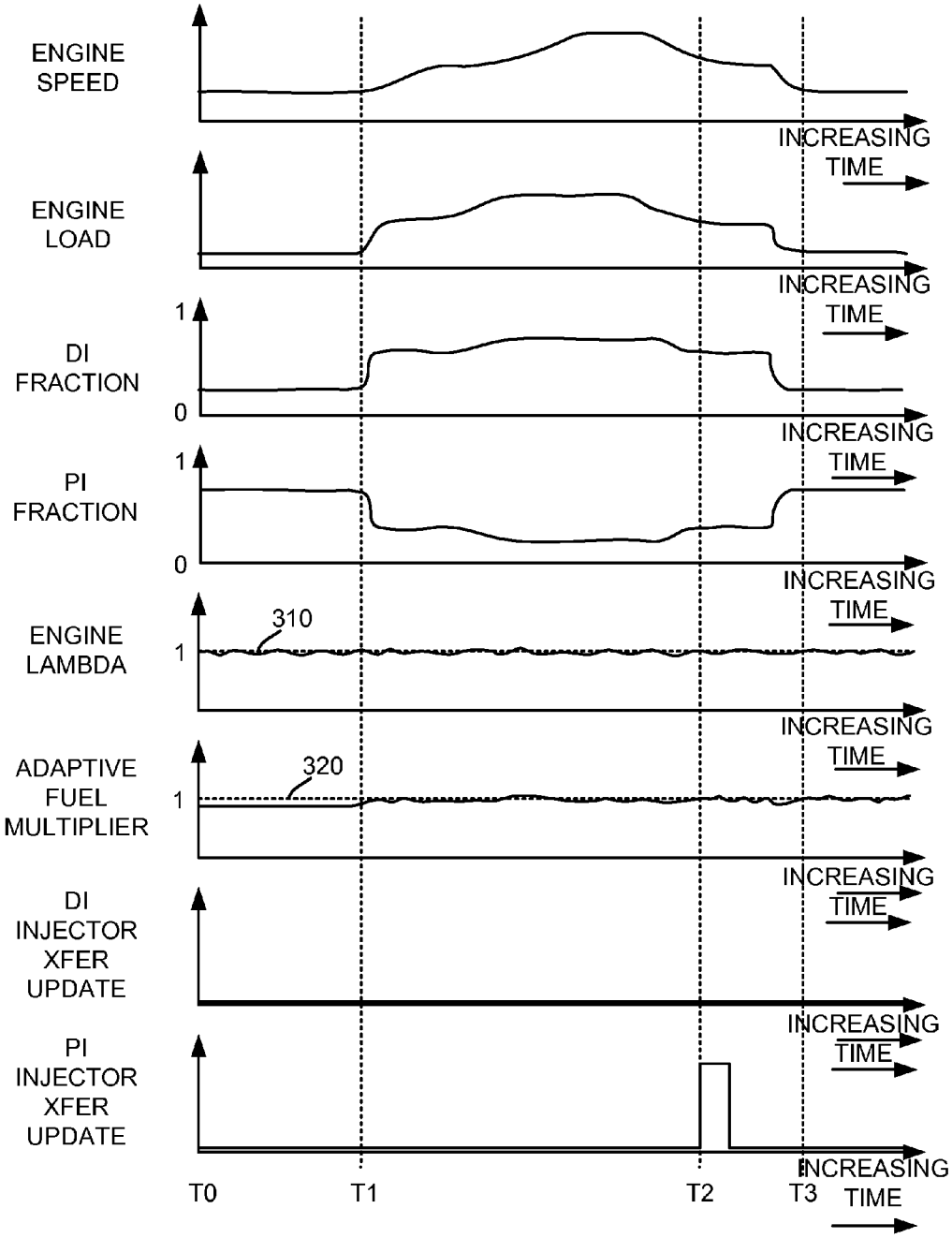
FIG. 3 shows an example simulated fuel adaptation sequence.

Referring now to FIG. 3, an example simulated fuel adaption sequence is shown. The sequence of FIG. 3 may be provided by the method of FIG. 4 operating in the system of FIG. 1. Vertical markers at times T1-T3 represent times of interest during the sequence.

The first plot from the top of FIG. 3 is a plot of engine speed versus time. The Y axis represents engine speed and engine speed increases in the direction of the Y axis arrow. The X axis represents time and time increases from the left side of the plot to the right side of the plot.

The second plot from the top of FIG. 3 is a plot of engine load versus time. The Y axis represents engine load and engine load increases in the direction of the Y axis arrow. The X axis represents time and time increases from the left side of the plot to the right side of the plot.

The third plot from the top of FIG. 3 is a plot of directly injected fuel fraction during an engine cycle versus time. The Y axis represents the directly injected fuel fraction and the directly injected fuel fraction increases in the direction of the Y axis arrow. The X axis represents time and time increases from the left side of the plot to the right side of the plot.

The fourth plot from the top of FIG. 3 is a plot of port injected fuel fraction during an engine cycle versus time. The Y axis represents the port injected fuel fraction and the port injected fuel fraction increases in the direction of the Y axis arrow. The X axis represents time and time increases from the left side of the plot to the right side of the plot.

The fifth plot from the top of FIG. 3 is a plot of engine commanded lambse versus time. The Y axis represents engine lambse and engine speed increases in the direction of the Y axis arrow. The X axis represents time and time increases from the left side of the plot to the right side of the plot. Horizontal dotted line 310 represents a lambse value of one.

The sixth plot from the top of FIG. 3 is a plot of an adaptive fuel multiplier (e.g., Kamrf) versus time. The Y axis represents the adaptive fuel multiplier and the value of the adaptive fuel multiplier increases in the direction of the Y axis arrow. The X axis represents time and time increases from the left side of the plot to the right side of the plot. Horizontal dotted line 320 represents an adaptive fuel multiplier value of one.

The seventh plot from the top of FIG. 3 is a plot of direct fuel injector transfer function (XFER) update state versus time. The direct fuel injector (DI) transfer function may be updated if a trace is at a higher level near the Y axis arrow. The direct fuel injector transfer function is not updated if the trace is at a lower level near the X axis.

The eighth plot from the top of FIG. 3 is a plot of port fuel injector (PI) transfer function (XFER) update state versus time. The port fuel injector transfer function may be updated if a trace is at a higher level near the Y axis arrow. The port fuel injector transfer function is not updated if the trace is at a lower level near the X axis.

At time T0, engine speed and load are at lower levels. The direct injection fuel fraction is low and the port fuel injection fraction is relatively high. Larger port fuel injection fractions may be desirable at lower engine loads since port injected fuel vaporizes well at lower engine loads and direct injection fuel pump may be reduced when the direct injection fuel amount is low. The engine air-fuel ratio feedback correction lambse value is oscillating about a value of one. The adaptive fuel multiplier is less than a value of one (e.g., 0.92) and direct and port fuel injector transfer functions are not being updated as indicated by the direct and port injector transfer function update states. The direct injection fuel fraction, port injected fuel fraction, and adaptive fuel multiplier are stored in memory (not shown).

At time T1, the engine speed and load increase in response to an increase in driver demand torque (not shown). The direct injection fuel fraction increases and the port fuel injection fraction decreases at the higher engine speed and loads. The direct injection fuel fraction may be increased at higher speeds and loads to cool cylinder charge and reduce the possibility of engine knock. The engine air-fuel ratio feedback correction lambse continues to oscillate around a value of one. The adaptive fuel multiplier increases to a value of nearly one. The direct and port fuel injector transfer functions are not being updated as indicated by the direct and port injector transfer function update states. The direct injection fuel fraction, port injected fuel fraction, and adaptive fuel multiplier are stored in memory after engine operating conditions stabilize after time T1 and before time T2 (not shown).

At time T2, engine speed and load have been reduced in response to a reduction in driver demand torque (not shown). The direct injection fuel fraction decreases and the port fuel injection fraction increases at the lower engine speed and loads. The engine air-fuel ratio feedback correction lambse continues to oscillate around a value of one. The adaptive fuel multiplier remains at a value of nearly one. The direct injector transfer function is not updated, but the port fuel injector transfer functions is updated based on the data stored between time T0 and time T1 and the data stored between time T1 and time T2. In particular, the change in the adapted fuel multiplier is divided by the change in the direct injection fuel fraction. Further, the change in the adapted fuel multiplier is divided by the change in the port injection fuel fraction. In this example, the adapted fuel multiplier divided by the port fuel injector fuel fraction indicated degradation. The port fuel injector transfer function is updated in response to the indication of port injection degradation. In one example, the port fuel injector slope of fuel flow rate may be incremented or decremented in response to the port injection degradation. The port fuel injectors are operated with the revised transfer function after the port injector transfer function update trace returns to a lower level.

At time T3, the engine returns to engine speed and load conditions present at time T0. However, the adaptive fuel multiplier value changes to a value near one in response to the port fuel injectors operating with the revised port fuel injector transfer function.

In this way, degradation in fuel control between port and direct fuel injection systems delivering fuel to a cylinder may be determined and mitigated. Further, if errors between the port and direct fuel injection system are determined to be nearly identical and large, it may be an indication of degradation in the engine air estimation system or it may be due to a fueling type (e.g., ethanol, methanol, etc.) of error. In a case where there may be an error in an ethanol or alternative fuel detection system, it may be reflected as a slope change in kamrf values.

Figure 4:
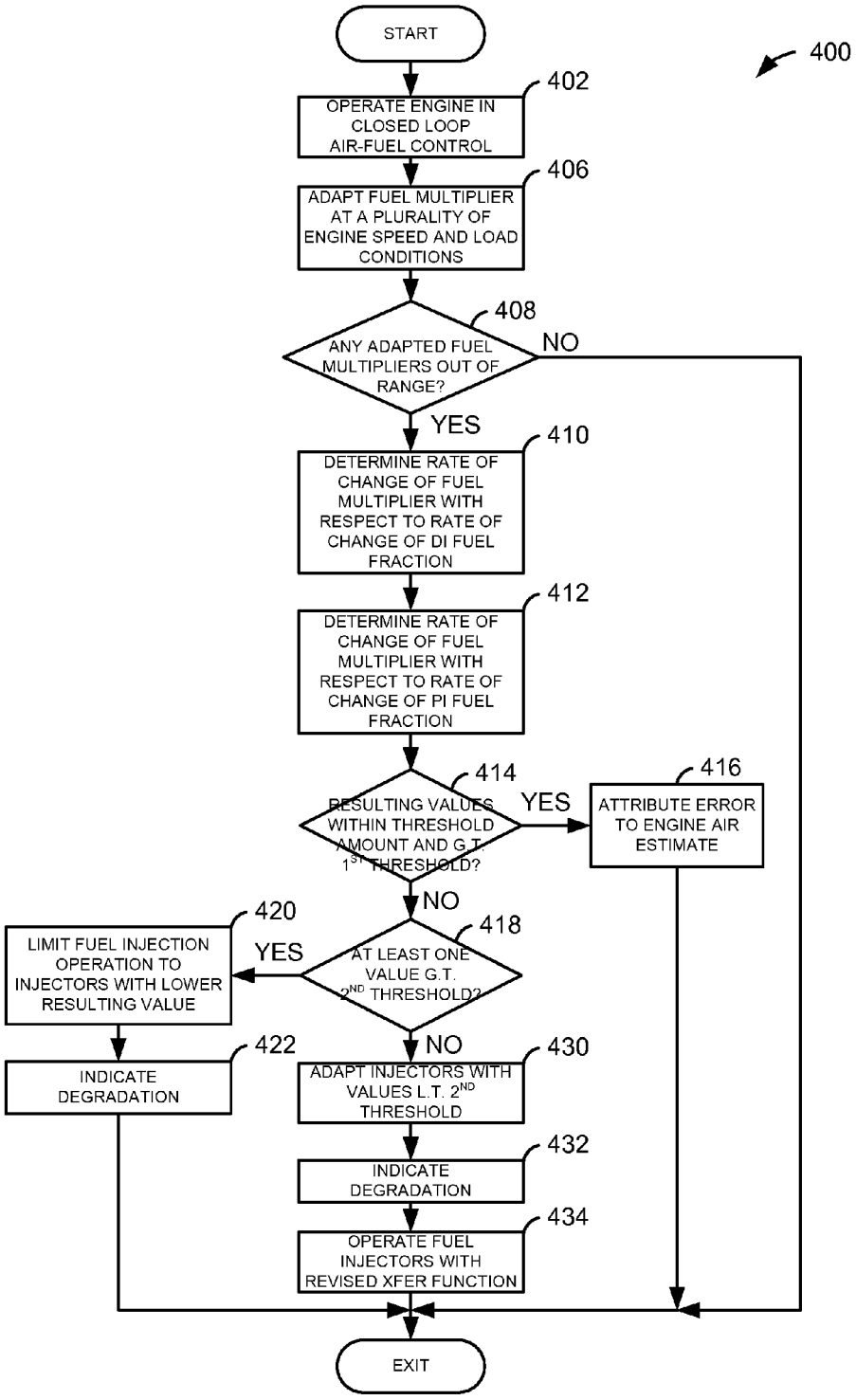
FIG. 4 is a flowchart of an example method for determining degraded fueling sources.

Referring now to FIG. 4, a flowchart of an example method for determining and isolating degraded fueling sources is shown. FIG. 4 also describes mitigating actions for conditions when degradation is determined. The method of FIG. 4 may be stored as executable instructions in non-transitory memory of the system shown in FIG. 1.

At 402, method 400 operates an engine in closed loop air-fuel control mode. During closed loop air-fuel control, the controller determines a desired engine air-fuel ratio by indexing tables and/or functions based on driver demand torque, engine speed, and other conditions. Fuel is injected to provide the desired engine air-fuel ratio and feedback from an oxygen sensor is used to adjust the amount of fuel injected. The injected fuel amount may be port and/or directly injected. Method 400 continues to 406 after the engine begins to operate in closed loop fuel control mode.

At 406, method 400 adapts a value of a fuel modifier based on if the exhaust gas oxygen sensor is observing lean or rich fuel mixture combustion products in the exhaust system. In one example, if the lambse air-fuel feedback parameter is indicating lean or rich over an extended time period, the adapted fuel multiplier (e.g., Kamrf) is incremented or decremented from its initial value of one. The fuel multiplier may be adapted at a plurality of engine speed and load conditions. Further, at selected engine speed and load conditions, the adapted fuel multiplier is stored to memory. Additionally, the fractions of port injected fuel and directly injected fuel are stored at the same speeds and loads where the adapted fuel multiplier is stored. Method 400 proceeds to 408 after the fuel multiplier is adapted.

At 408, method 400 judges if any of the adapted fuel multipliers are out of range, or alternatively, method 400 may judge if a sufficient number of adapted fuel multipliers have been stored to memory (e.g., at least two distinct adapted fuel multipliers and their corresponded direct injection fuel fraction and port injection fuel fraction). If so, the answer is yes and method 400 proceeds to 410. Otherwise, the answer is no and method 400 exits and continues to operate in closed loop air-fuel control adapting a plurality of fuel multipliers for different engine speed and load conditions.

At 410, method 400 determines a rate of change between two or more fuel multipliers determined and stored for different engine speeds and loads. Additionally, method 400 determines a rate of change in the direct fuel injection fraction for the same engine speeds and load. In one example, as illustrated and explained in the description of FIG. 2, Kamrf values at two different engine speeds and loads may be evaluated to determine a slope rate of change between the adapted fuel multipliers and the change in direct injected fuel fraction. The relationship may be expressed as:

$$\frac{d(Kamrf)}{d(di_{frac})} = \text{di_Kamrf}$$

where di_Kamrf is the slope of rate of change of Kamrf with respect to a change in direct injection fuel fraction, where Kamrf is the adapted fuel multiplier, and $di_{frac}$ is the direct injection fuel fraction. Method 400 proceeds to 412 after the slope rate of change of Kamrf with respect to a change in direct injection fuel fraction is determined.

At 412, method 400 determines a rate of change in the port fuel injection fraction for the same engine speeds and loads as described at 408. In one example, as illustrated and explained in the description of FIG. 2, Kamrf values at two different engine speeds and loads may be evaluated to determine a slope rate of change between the adapted fuel multipliers and the change in port injection fuel fraction. The relationship may be expressed as:

$$\frac{d(Kamrf)}{d(1-di_{frac})} = \text{pfi_Kamrf}$$

where pfi_Kamrf is the slope of rate of change of Kamrf with respect to a change in port injected fuel fraction, where Kamrf is the adapted fuel multiplier, and $di_{frac}$ is the direct injection fuel fraction. Method 400 proceeds to 414 after the slope rate of change of Kamrf with respect to a change in direct injection fuel fraction is determined.

By determining the slope of rate of change of Kamrf with respect to a change in port injected fuel fraction, and the slope of rate of change of Kamrf with respect to a change in direct injected fuel fraction, engine fueling errors may be allocated between port and direct fuel injection systems. For example, the greater the absolute value of the slope of rate of change of Kamrf with respect to a change in direct injected fuel fraction, the greater amount of fueling error is attributed to the direct fuel injection system.

At 414, method 400 judges if the resulting absolute values from step 410 and step 412 are within a threshold amount of each other and greater than (G.T.) a first threshold amount. If so, the answer is yes and method 400 proceeds to 416. If not, the answer is no and method 400 proceeds to 418. If the resulting values from step 410 and 412 are close in value, but larger than the first threshold amount, it may be an indication of degradation in the engine air estimation system (e.g., a degraded pressure sensor) or a fuel type (e.g., ethanol, methanol, etc.) error. Otherwise, there may be expected to be some difference between the port and direct injection ratios of Kamrf slope rate of change with respect to fuel fraction change determined at 410 and 412.

At 416, method 400 attributes the Kamrf adapted values to degradation in the engine air amount estimation system (e.g., pressure sensors, MAF sensor, etc.). Method 400 may set a bit in memory and activate a light or indicate air system degradation to the driver. Further, method 400 may take mitigating actions such as performing diagnostics on air system components to determine if any specific components may be determined to be degraded. For example, method 400 may retard spark timing and open a throttle when a vehicle is in park to determine if a MAP sensor responds as expected. Method 400 proceeds to exit after an indication of engine air system degradation is indicated.

At 418, method 400 judges if at least one of the slope of rate of change of Kamrf with respect to a change in direct injection fuel fraction, or the slope of rate of change of Kamrf with respect to a change in port injection fuel fraction, is greater than (G.T.) a second threshold value. If so, the answer is yes and method 400 proceeds to 430. Otherwise, the answer is no and method 400 proceeds to 420.

At 420, method 400 limits fuel injection to the injection system (e.g., port or direct injectors) with the lower slope rate of change of Kamrf with respect to the change in port or direct injection fraction. For example, if it is determined that the slope rate of change of Kamrf with respect to the change in direct injection fraction is greater than the second threshold, method 400 deactivates or reduces an actual total number of operating conditions where direct injection is operable over an engine speed and load range. The port fuel injection system remains operable and operates during conditions were the direct fuel injector previously operated. Likewise, if it is determined that the slope rate of change of Kamrf with respect to the change in port injection fraction is greater than the second threshold, method 400 deactivates or reduces an actual total number of operating conditions where port injection is operable over an engine speed and load range. The direct injector continues to operate and it operates in conditions where the port fuel injector previously operated. Method 400 proceeds to 422 after mitigating measures are begun.

At 422, method 400 provides an indication of fuel system degradation, including fuel injector degradation. In one example, the indication may be via a display or activating a light. Further, the indication may include setting a value of a variable stored in memory. Method 400 proceeds to exit after fuel system degradation is indicated.

At 430, method 400 adjusts a transfer function of direct fuel injectors if the direct fuel injector absolute value of the slope rate of change of Kamrf with respect to the change in direct injection fraction is greater than the slope rate of change of Kamrf with respect to the change in port injection fraction. On the other hand, method 400 adjusts a transfer function of port fuel injectors if the port fuel injector absolute value of the slope rate of change of Kamrf with respect to the change in port injection fraction is greater than the slope rate of change of Kamrf with respect to the change in direct injection fraction. In one example, the flow rate of the port injectors may be incremented or decremented to adjust the port injector transfer function. Likewise, the flow rate of direct injectors may be incremented or decremented to adjust the direct injector transfer function. Adjusting the fuel injector transfer function adjusts fuel injector on timing since fuel flow is related to fuel injector on time. Method 400 proceeds to 432 after a direct or port injector transfer function is adjusted.

At 432, method 400 provides an indication of fuel system degradation, including fuel injector degradation. In one example, the indication may be via a display or activating a light. Further, the indication may include setting a value of a variable stored in memory. Method 400 proceeds to 434 after fuel system degradation is indicated.

At 434, method 400 operates fuel injectors with the revised transfer (XFER) function. The injectors increase and decrease the amount of fuel supplied to the engine based on engine speed and load as well as the revised injector transfer function. Method 400 proceeds to exit after fuel injectors are operated.

Thus, the method of FIG. 4 provides for a method for fueling a cylinder, comprising: injecting fuel to the cylinder via a first fuel injector and a second fuel injector; and indicating degradation of the first fuel injector or the second fuel injector in response to a rate of change of air-fuel ratio error and a fraction of fuel injected via the first fuel injector or the second fuel injector. The method further comprises adjusting a transfer function of the first fuel injector or the second fuel injector in response to the rate of change of air-fuel ratio error and the fraction of fuel injected via the first fuel injector or the second fuel injector. The method includes where the rate of change of air-fuel ratio error is divided by the fraction of fuel injected via the first fuel injector.

In some examples, the method includes where the rate of change of air-fuel ratio error is divided by the fraction of fuel injected via the second fuel injector. The method includes where the first fuel injector is a direct fuel injector and where the second fuel injector is a port fuel injector. The method further comprises deactivating the first fuel injector or the second fuel injector in response to degradation of the first fuel injector or the second fuel injector. The method includes where the degradation is indicated by adjusting a state of an actuator such as a light or display panel.

The method of FIG. 4 also provides for a method for fueling a cylinder, comprising: injecting fuel to the cylinder via a first fuel injector and a second fuel injector during a cylinder cycle; assigning a first portion of an air-fuel error from the cylinder during the cylinder cycle to the first fuel injector based in a first fuel fraction provided by the first fuel injector; assigning a second portion of an air-fuel error from the cylinder during the cylinder cycle to the second fuel injector based in a second fuel fraction provided by the second fuel injector; and adjusting operation of the first fuel injector or the second fuel injector in response to the greater of the first portion or the second portion.

In some examples, the method includes where the air-fuel error is a change in air-fuel error, the first fuel fraction is a first change in fuel fraction, and the second fuel fraction is a second change in fuel fraction. The method further comprises dividing the change in air-fuel error by the first change in fuel fraction. The method further comprises dividing the change in air-fuel error by the second change in fuel fraction. The method includes where the air-fuel error in a form of an adapted fuel multiplier. The method includes where the first fuel injector is a port fuel injector and where the second fuel injector is a direct fuel injector. The method further comprises limiting operation of the first fuel injector or the second fuel injector in response to the greater of the first portion or the second portion.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for fueling a cylinder, comprising:

injecting fuel to the cylinder via a first fuel injector and a second fuel injector;

indicating degradation of the first fuel injector or the second fuel injector in response to a rate of change of air-fuel ratio error and a fraction of fuel injected via the first fuel injector or the second fuel injector; and adjusting a transfer function of the first fuel injector or the second fuel injector in response to the rate of change of air-fuel ratio error and the fraction of fuel injected via the first fuel injector or the second fuel injector.

2. The method of claim 1, where the degradation is indicated by adjusting a state of an actuator such as a light or display panel.

3. The method of claim 1, where the rate of change of air-fuel ratio error is divided by the fraction of fuel injected via the first fuel injector.

4. The method of claim 1, where the rate of change of air-fuel ratio error is divided by the fraction of fuel injected via the second fuel injector.

5. The method of claim 1, where the first fuel injector is a direct fuel injector and where the second fuel injector is a port fuel injector.

6. The method of claim 1, further comprising deactivating the first fuel injector or the second fuel injector in response to degradation of the first fuel injector or the second fuel injector.

7. A method for fueling a cylinder, comprising:

injecting fuel to the cylinder via a first fuel injector and a second fuel injector during a cylinder cycle;

assigning a first portion of an air-fuel error from the cylinder during the cylinder cycle to the first fuel injector based in a first fuel fraction provided by the first fuel injector, where the air-fuel error is in a form of an adapted fuel multiplier;

assigning a second portion of an air-fuel error from the cylinder during the cylinder cycle to the second fuel injector based in a second fuel fraction provided by the second fuel injector; and adjusting operation of the first fuel injector or the second fuel injector in response to the greater of the first portion or the second portion.

8. The method of claim 7, where the air-fuel error is a change in air-fuel error, the first fuel fraction is a first change in fuel fraction, and the second fuel fraction is a second change in fuel fraction.

9. The method of claim 8, further comprising dividing the change in air-fuel error by the first change in fuel fraction.

10. The method of claim 8, further comprising dividing the change in air-fuel error by the second change in fuel fraction.

11. The method of claim 7, where the first fuel injector is a port fuel injector and where the second fuel injector is a direct fuel injector.

12. The method of claim 7, further comprising limiting operation of the first fuel injector or the second fuel injector in response to the greater of the first portion or the second portion.

13. A system, comprising:

an engine including a cylinder;

a port fuel injector in fluidic communication with the cylinder;

a direct fuel injector in fluidic communication with the cylinder; and a controller including executable instructions stored in non-transitory memory for indicating degradation of the port fuel injector or the direct fuel injector and adjusting an actuator in response to a ratio of a change in air-fuel error to a change in fuel fraction.

14. The system of claim 13, where the actuator is a fuel injector.

15. The system of claim 13, where the change in air-fuel error is based on a change in an adapted fuel multiplier.

16. The system of claim 13, further comprising adapting operation of a fuel injector in response to the ratio.

17. The system of claim 13, where the indication of degradation is via a display panel.

18. The system of claim 13, further comprising operating the engine in closed loop air-fuel control to determine air-fuel ratio errors.

* * * * *